US009990901B2

(12) United States Patent
Yoon et al.

(10) Patent No.: US 9,990,901 B2
(45) Date of Patent: Jun. 5, 2018

(54) METHOD AND APPARATUS FOR CONTROLLING SCREEN

(71) Applicant: Samsung Electronics Co., Ltd, Gyeonggi-do (KR)

(72) Inventors: Sung-Jin Yoon, Gyeonggi-do (KR); Young-Il Oh, Gyeonggi-do (KR); Dong-Ho Koo, Busan (KR); Sung-Taek Kim, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 231 days.

(21) Appl. No.: 14/935,219

(22) Filed: Nov. 6, 2015

(65) Prior Publication Data

US 2016/0133228 A1 May 12, 2016

(30) Foreign Application Priority Data

Nov. 7, 2014 (KR) ..... 10-2014-0154433

(51) Int. Cl.
*G09G 5/02* (2006.01)
*G09G 5/10* (2006.01)

(52) U.S. Cl.
CPC ..... *G09G 5/02* (2013.01); *G09G 2330/021* (2013.01); *G09G 2330/022* (2013.01); *G09G 2370/022* (2013.01)

(58) Field of Classification Search
CPC ..... G09G 2330/021; G09G 2330/022; G09G 2370/022; G09G 5/02
See application file for complete search history.

(56) References Cited

U.S. PATENT DOCUMENTS 5,065,357 A * 11/1991 Shiraishi ..... G06F 1/3218 345/102
2005/0052446 A1* 3/2005 Plut ..... G06F 1/3218 345/211
2008/0136262 A1* 6/2008 Hara ..... H02J 1/08 307/80
2011/0145738 A1* 6/2011 Laugwitz ..... G06F 3/0482 715/763
2012/0066640 A1* 3/2012 Kwak ..... G06F 9/4443 715/788
2012/0320397 A1* 12/2012 Kishimoto ..... G03G 15/5016 358/1.13
2013/0191791 A1* 7/2013 Rydenhag ..... G06F 3/017 715/863
2015/0035779 A1* 2/2015 Guarneri ..... G06F 3/041 345/173

(Continued)

FOREIGN PATENT DOCUMENTS

KR 10-2007-0113889 11/2007
KR 10-2011-0070046 6/2011

*Primary Examiner* — Patrick Edouard
*Assistant Examiner* — Peijie Shen

(57) ABSTRACT

An electronic device is provided. The electronic device is configured to check whether an event is generated during a first period in a state in which a screen is displayed, change a chroma of the screen when the event is not generated during the first period, check whether the event is generated during a second period, and adjust a lighting brightness of the screen when the event is not generated during the second period.

12 Claims, 8 Drawing Sheets
(4 of 8 Drawing Sheet(s) Filed in Color)

(56) References Cited

U.S. PATENT DOCUMENTS

| | | | | |
|---|---|---|---|---|
| 2015/0067613 | A1* | 3/2015 | Kim | G06F 3/017 715/863 |
| 2015/0070362 | A1* | 3/2015 | Hirai | G06F 3/0482 345/475 |
| 2015/0234457 | A1* | 8/2015 | Kempinski | G06F 3/013 345/156 |
| 2015/0370447 | A1* | 12/2015 | Jitkoff | G06F 3/0482 715/835 |
| 2016/0086568 | A1* | 3/2016 | Imamura | G06F 3/16 345/643 |

* cited by examiner

METHOD AND APPARATUS FOR CONTROLLING SCREEN

CROSS-REFERENCE TO RELATED APPLICATION(S) AND CLAIM OF PRIORITY

The present application is related to and claims the priority under 35 U.S.C. § 119(a) to Korean Application Serial No. 10-2014-0154433, which was filed in the Korean Intellectual Property Office on Nov. 7, 2014, the entire content of which is hereby incorporated by reference.

TECHNICAL FIELD

The present disclosure relates to a method and an apparatus associated with a screen.

BACKGROUND

Generally, in order to prevent unnecessary power consumption owing to a display, and to prevent abrasion of the display, when a user's input is not sensed during a predetermined period, a display protection image is displayed or the power of the screen is cut off. For example, in a case of a portable electronic device, when a user's input is not generated during a predetermined time, firstly a lighting of a screen is darkened, and when the user's input is not continuously generated, the screen is turned off.

SUMMARY

If a screen control is performed in more varied processes, the screen control may arouse a user's interest, and give pleasure to a user. In addition, a screen control method that enables a user to intuitionally recognize a screen control state is necessary.

To address the above-discussed deficiencies, it is a primary object to provide a method and an apparatus that gradually controls a screen, when an operation event of a device is not generated for a predetermined time or a user's input is not generated. In addition, various embodiments of the present disclosure provide a method and an apparatus that provides various visual effects in a screen protection state and restore a screen to a screen display state in which the screen is turned on. In addition, various embodiments of this disclosure provide a method and an apparatus for controlling a screen that can arouse a user's interest.

In a first embodiment, a method to control a screen of an electronic device is provided. The method includes checking whether an event is generated during a first period in a state in which a screen is displayed. The method also includes changing a chroma of the screen when the event is not generated during the first period. The method further includes checking whether the event is generated during a second period. The method includes adjusting a lighting brightness of the screen when the event is not generated during the second period.

In a second embodiment, an electronic device is provided. The electronic device includes a display and a screen control module. The screen control module is configured to check whether an event is generated during a first period in a state in which a screen of the display is displayed. The screen control module is further configured to change a chroma of the screen when the event is not generated during the first period. The screen control module is further configured to check whether the event is generated during a second period.

The screen control module is configured to adjust a lighting brightness of the screen when the event is not generated during the second period.

The various embodiments of the present disclosure can gradually control a screen, when an operation event of a device is not generated for a predetermined time or a user's input is not generated. In addition, the various embodiments of the present disclosure can provide various visual effects in a state in which a screen is displayed, and can restore a screen to a screen display state in which the screen is turned on. Thus, the various embodiments of the present disclosure can arouse a user's interest.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a more complete understanding of the present disclosure and its advantages, reference is now made to the following description taken in conjunction with the accompanying drawings, in which like reference numerals represent like parts.

DETAILED DESCRIPTION

Figure 1:
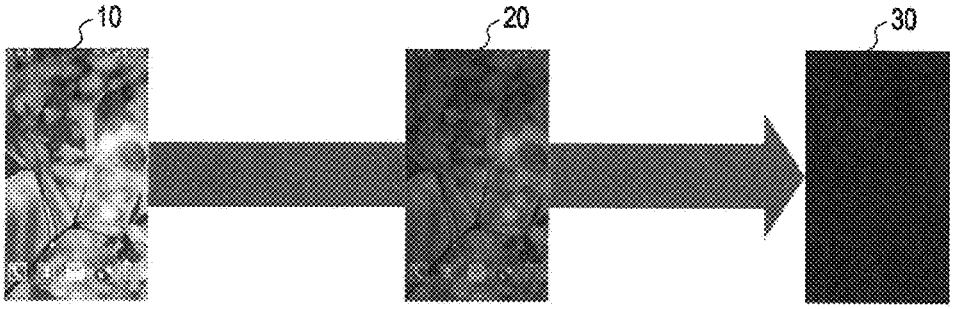
FIG. 1 is a view illustrating an example screen control process according to this disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device. Hereinafter, various embodiments of the present disclosure will be described with reference to accompanying drawings. The present disclosure may be modified in various forms and include various embodiments, but specific examples are illustrated in the drawings and described in the description. However, the description is not intended to limit the present disclosure to the specific embodiments, and it shall be appreciated that all the changes, equivalents and substitutions belonging to the idea and technical scope of the present disclosure are included in the present disclosure. In the description of the drawings, identical or similar reference numerals are used to designate identical or similar elements.

Hereinafter, the terms "include" or "may include", which may be used in various embodiments of the present disclosure, refer to the presence of disclosed functions, operations or elements, and do not restrict the addition of one or more functions, operations or elements. Further, as used in embodiment of the present disclosure, the terms "include", "have" and their conjugates may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

The term "or" in various embodiments of the disclosure means the inclusion of at least one or all of the disclosed elements. For example, the expression "A or B" may include A, may include B, or may include both A and B.

The expressions such as "first," "second,' or the like used in various embodiments of the present disclosure may modify various component elements in the various embodiments but may not limit corresponding component elements. For example, the above expressions do not limit the sequence and/or importance of the corresponding elements. The expressions may be used to distinguish a component element from another component element. For example, a first user device and a second user device indicate different user devices although both of them are user devices. For example, without departing from the scope of the present disclosure, a first component element may be named a second component element. Similarly, the second component element also may be named the first component element.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

In the present disclosure, the terms are used to describe a specific embodiment, and are not intended to limit the present disclosure. As used herein, the singular forms are intended to include the plural forms as well, unless the context clearly indicates otherwise. Unless defined differently, all terms used herein, which include technical terminologies or scientific terminologies, have the same meaning as a person skilled in the art to which the present disclosure belongs. Such team as those defined in a generally used dictionary are to be interpreted to have the meanings equal to the contextual meanings in the relevant field of art, and are not to be interpreted to have ideal or excessively formal meanings unless clearly defined in the present disclosure.

An electronic device according to various embodiments of the present disclosure is a device having an antenna. For example, the electronic devices includes at least one of smart phones, tablet personal computers (PCs), mobile phones, video phones, e-book readers, desktop PCs, laptop PCs, netbook computers, personal digital assistants (PDAs), portable multimedia players (PMPs), MP3 players, mobile medical devices, cameras, wearable devices (such as a head-mounted-devices (HMDs) such as electronic glasses), electronic clothes, electronic bracelets, electronic necklaces, electronic appcessories, electronic tattoos, or smart watches.

According to some embodiments, the electronic device includes at least one of various medical devices (such as Magnetic Resonance Angiography (MRA)), a navigation device, a Global Positioning System (GPS) receiver, a Event Data Recorder (EDR), a Flight Data Recorder (FDR), an automobile infotainment device, a security device, and a home robot. An electronic device according to various embodiments of the present disclosure is a device having a display. Also, an electronic device according to various embodiments of the present disclosure is not limited to the above described devices. Hereinafter, an electronic device according to various embodiments of the present disclosure will be described with reference to the accompanying drawings. In various embodiments, the term "user" may indicate a person using an electronic device or a device (e.g. an artificial intelligence electronic device) using an electronic device.

Generally, in order to prevent unnecessary power consumption owing to a display, and to prevent abrasion of the display, when a user's input is not sensed during a predetermined period, a display protection image is displayed or the power of the screen is cut off. For example, in a case of a portable electronic device, when a user's input is not generated during a predetermined time, firstly a lighting of a screen is darkened, and when the user's input is not continuously generated, the screen is turned off.

FIG. 1 is a view illustrating an example screen control process according to this disclosure. In FIG. 1, a screen 10 shows that a screen display state when the screen is turned on. When a user's input is not generated, an electronic device darkens a lighting of the screen like a screen 20. In addition, when the user's input is not continuously generated, the electronic device turns off the screen as shown at screen 30. When the user's input is sensed in a state in which the lighting is darkened as shown at screen 20, the screen is restored to a display state in which the screen is turned on as shown at screen 10.

Figure 2:
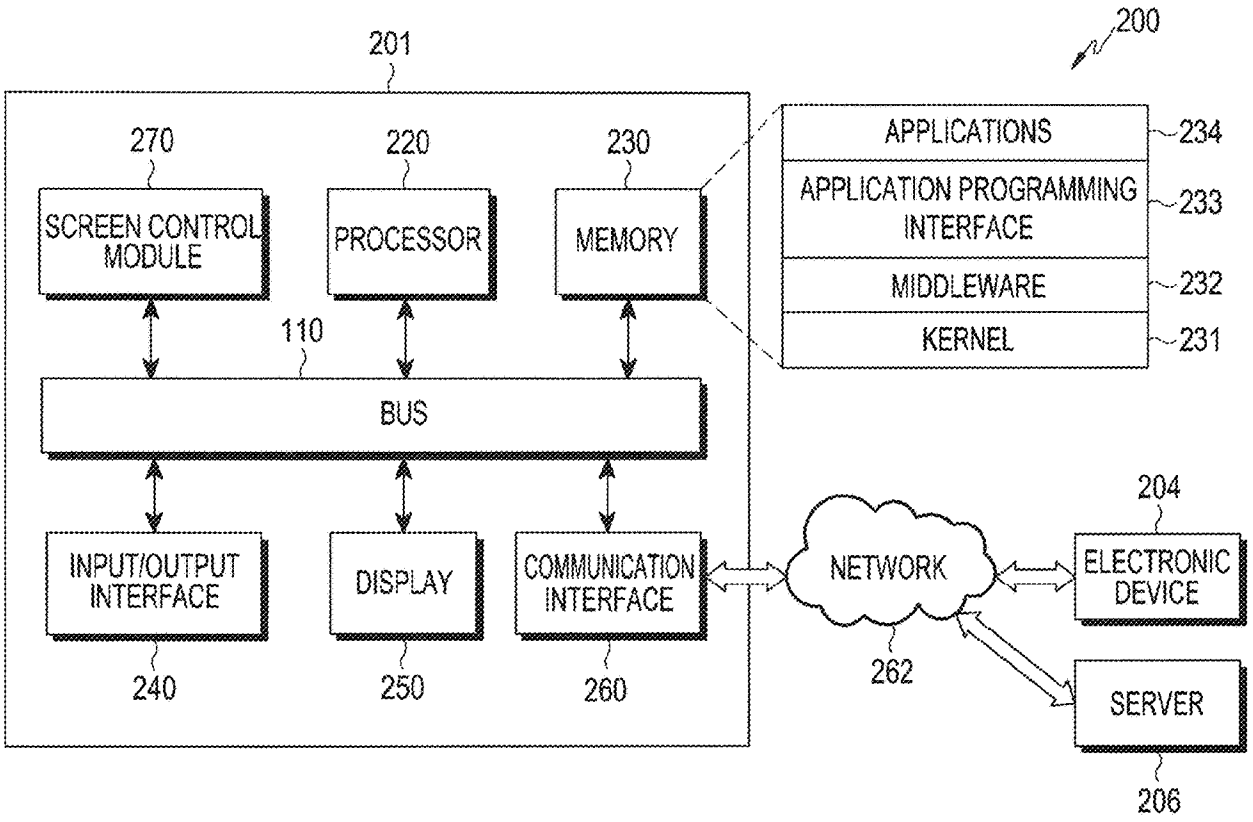
FIG. 2 illustrates an example network environment including an example electronic device according to this disclosure.

FIG. 2 illustrates an example network environment 200 including an electronic device 201 according to this disclosure. Referring to FIG. 2, the electronic device 201 includes a bus 210, a processor 220, a memory 230, an input/output interface 240, a communication interface 260, a display 250, and a screen control module 270. The bus 210 is a circuit to connect the above-described components with each other and to transfer a communication (for example, a control messages) between the above-described components. The processor 220 receives a command from other components (for example, the memory 230, the input/output interface 240, the display 250, the communication interface 260, or the screen control module 270) through the bus 210, analyzes the received command, and performs a calculation or data processing according to the analyzed command. The memory 230 stores commands or data received from or generated by the processor 220 or other components (for example, the input/output interface 240, the display 250, the communication interface 260, or the screen control module 270). The memory 230 includes programming modules, for example, a kernel 231, a middleware 232, an Application Programming Interface (API) 233, or an application 234. Each of the programming modules described above is formed of software, firmware, and hardware, or a combination thereof.

The kernel 231 controls or manages system resources (for example, the bus 210, the processor 220, or the memory 230) used for executing an operation or a function implemented by the remaining other programming modules, for example, the middleware 232, the API 233, or the application 234. Furthermore, the kernel 231 provides an interface through which the middleware 232, the API 233, and the application 234 accesses individual component elements of the electronic device 201 to control or manage them. The middleware 232 performs a relay function to allow the API 233 or the application 234 to communicate with the kernel 231 to exchange data. Further, in relation to requests for operation received from the applications 234, the middleware 232 controls (such as scheduling or load-balancing) the requests by using, for example, a method of determining sequence for using system resources (such as the bus 210, the processor 220, the memory 230, or the like) of the electronic device 201 with respect to at least one application among the applications 234. The API 233 is an interface by which the application 234 controls a function provided by the kernel 231 or the middleware 232 and includes, for example, at least one interface or function for a file control, a window control, image processing, or a character control.

The application 234 includes a Short Message Service (SMS)/Multimedia Messaging Service (MMS) application, an email application, a calendar application, an alarm application, a health care application (for example, application measuring a quantity of exercise or blood sugar), or an environment information application (for example, application providing information on pressure, humidity or temperature). Additionally or alternatively, the applications 234 is an application related to the exchange of information between the electronic device 201 and external electronic devices (such as an electronic device 204). The application related to the information exchange includes, for example, a notification relay application for transferring particular information to the external electronic device or a device management application for managing the external electronic device.

For example, the notification relay application includes a function of transmitting notification information generated by another application (for example, SMS/MMS application, email application, health care application or environment information application) of the electronic device 201 to the external electronic device (for example, electronic device 204). Additionally or alternatively, the notification relay application receives notification information from, for example, an external electronic device (such as the electronic device 204) and provides the same to a user. The device management application manages (for example, install, remove, or update) at least a part of functions (for example, turning on/off the external electronic device (or some components of the external electronic device) or controlling the brightness of the display) of the external electronic device (for example, electronic device 204) communicating with the electronic device 201, an application executed in the external electronic device, or a service (for example, call service or message service) provided by the external electronic device.

According to various embodiments, the application 234 includes an application designated according to an attribute (for example, type of electronic device) of the external electronic device (for example, electronic device 204). For example, in a case where the external electronic device is an MP3 player, the application 234 includes an application related to the reproduction of music. Similarly, when the external electronic device is a mobile medical device, the application 234 includes an application related to the health care. According to an embodiment, the application 234 includes at least one of an application designated to the electronic device 201 and an application received from an external electronic device (for example, server 206 or electronic device 204).

The input/output interface 240 transfer a command or data input from a user through an input/output device (for example, the display 250, a keyboard or a touch screen) to the processor 220, the memory 230, the communication interface 260 or the screen control module 270 through, for example, the bus 210. For example, the input/output interface 240 provides, to the processor 220, data for a user's touch that is input through the touch screen. Further, through the input/output device (for example, a speaker or a display), the input/output interface 240 outputs commands or data received from the processor 220, the memory 130, the communication interface 160, or the screen control module 270 through the bus 210. For example, the input/output interface 240 outputs voice data processed through the processor 220 to a user through a speaker. The display 250 displays various pieces of information (for example, multimedia data or text data) to the user.

The communication interface 260 connects communication between the electronic device 201 and an external electronic device (for example, the electronic device 204 or the server 206). For example, the communication interface 260 is connected to a network 262 through wireless or wired communication to communicate with the external device. The wireless communication includes at least one of, for example, Wi-Fi, Bluetooth (BT), Near Field Communication (NFC), Global Positioning System (GPS) and cellular communication (for example, Long Term Evolution (LTE), LTE-A, Code Division Multiple Access (CDMA), Wideband CDMA (WCDMA), Universal Mobile Telecommunication System (UMTS), Wireless Broadband (WiBro), Global System for Mobile communication (GSM), and the like). The wired communication includes at least one of, for example, a Universal Serial Bus (USB), a High Definition Multimedia Interface (HDMI), Recommended Standard 232 (RS-232), and a Plain Old Telephone Service (POTS).

According to an embodiment, the network 262 is a telecommunication network. The communication network includes at least one of a computer network, the Internet, the Internet of things, and a telephone network. According to an embodiment, a protocol (for example, transport layer protocol, data link layer protocol, or physical layer protocol) for the communication between the electronic device 200 and the external device is supported by at least one of the application 234, the application programming interface 233, the middleware 232, the kernel 231, and the communication interface 260.

The screen control module 270 processes at least some pieces of information acquired from the other elements (such as the processor 220, the memory 230, the input/ output interface 240, and the communication interface 260), and provides the processed information to a user through various methods. For example, the screen control module 270 controls at least some of functions of the electronic device 200 to adjust a display state of the screen according to whether a screen maintenance event is generated or not during a predetermined period, using the process 220 or independently of the processor 220. Additional information on the screen control module 270 will be illustrated through FIGS. 3, 4, 5, 6, and 7 as disclosed herein.

Figure 3:
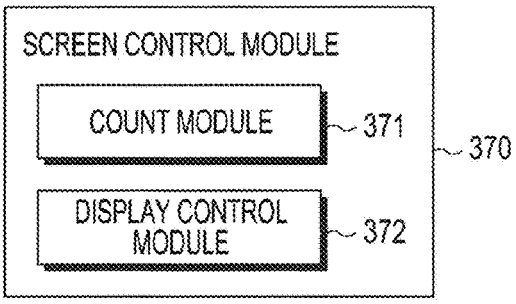
FIG. 3 is a view illustrating a construction of an example screen control module according to this disclosure.

FIG. 3 illustrates a construction of an example screen control module 370 of an example electronic device (such as the electronic device 201) according to this disclosure. Referring to FIG. 3, the screen control module 370 includes a count module 371 and a display control module 372. The count module 371 checks an elapsed time during a monitoring period of an event, according to a control of the screen control module 372.

According to an embodiment, the event is an event that displays a screen corresponding to the event or is an event that maintains a screen display state in a case in which a display state of the screen is turned on. For example, the event includes various notification event or various user's inputs. The notification event includes an event generated for notifying a reception of various data, a message, or a call through an external network. In addition, when information that should be notified to a user is generated according to an operation of the electronic device 201 or related to various applications installed in the electronic device 201, the notification event includes an event generated for this. The user's input includes various types of inputs such as an input through various key buttons installed in the electronic device 201, an input through a touch screen and a voice input through a microphone.

According to an embodiment, the display state of the screen includes a screen display state of the case in which the screen is turned on (hereinafter, referred to as a screen on state), a screen protection state, a screen restoration state, and a screen off state. The screen on state is a state in which data or contents are displayed according to a brightness of a backlight lighting and a pixel value process method of the screen basically set in the electronic device 201 or according to a basic performance supported by the display 250. The screen protection state is a state in which a color value such as a chroma is adjusted in a whole screen and data or contents are displayed or a state in which a lighting of the screen is adjusted, accordingly, as an event is not generated during a predetermined monitoring period. The screen restoration state is a state in which the screen is restored to the screen on state while a visual pattern described later is applied when the event is generated in the screen protection state.

The display control module 372 controls the count module 371 to check the elapsed time during the monitoring period from a time when the event is generated, and check whether the event is generated during the monitoring period. According to an embodiment, the monitoring period includes a first period, a second period and a third period. The first period is a predetermined period from the time when the event is generated. The second period is a predetermined period from a time when the first period is terminated. The third period is a predetermined period from a time when the second period is terminated. The first, second, and third periods can be the same or different. The first, second, and third periods can be designated by a user.

When the event is generated in the screen on state of the screen, the display control module 372 controls the count module 371 such that the count module 371 checks the elapsed time of the first period, and controls to maintain a basic screen display state of the screen. If, the event is generated again during the first period, the display control module 372 controls the count module 371 such that the count module 371 checks the elapsed time of the first period from a time when the event is generated again, and controls to continuously maintain the screen on state of the screen during the first period. If the event is not generated during the first period, the display control module 372 controls the count module 371 such that the count module 371 checks an elapsed time during the second period, and changes the chroma of the whole screen by adjusting values of each pixel constituting the screen in correspondence to a designated condition. At this time, the display control module 372 gradually changes the chroma of the screen during the second period. For example, the chroma is adjusted so that light of the whole screen is gradually faded.

In addition, when the event is generated during the second period, the display control module 372 restores the screen to the screen on state from the time when the event is generated. That is, the display control module 372 restores the chroma of the screen to a basic chroma by adjusting the values of each pixel constituting the screen. The basic chroma is a chroma of the screen of the screen on state. In addition, the display control module 372 controls the count module 371 such that the count module 371 checks the elapsed time of the first period, and controls to maintain the basic screen display state of the screen.

When the event is not generated during the second period, the display control module 372 adjusts a lighting of the screen in correspondence to a designated condition. In addition, the display control module 372 controls the count module 371 such that the count module 371 checks an elapsed time of the third period from a time when the second period is terminated. The display control module 372 checks whether the event is generated during the third period. When the event is generated, the display control module changes the lighting of the screen to a basic brightness, and restores the chroma of the screen to the basic chroma. The basic brightness of the lighting is a brightness of the lighting in the screen on state of the screen. In addition, the display control module 372 controls the count module 371 such that the count module 371 checks the elapsed time of the first period, and controls to maintain the basic screen display state of the screen. When the event is not generated, the display control module 372 turns off the power to the screen.

According to an embodiment, various visual patterns, according to a pattern of the user's input and an input position where the user's input is generated, is applied in a process of restoring the chroma of the screen to the basic chroma. For example, when a user touches a touch screen, an application of the visual pattern starts a chroma restoration from the point where the user's input is generated and expand the chroma restoration around the point where the user's input is generated, accordingly as the display control module 372 changes a value of a pixel corresponding to the touched point and sequentially values of adjacent pixels. A process of controlling a screen according to an embodiment in the electronic device 201 formed as described above is described with reference to FIGS. 4 and 5.

Figure 4:
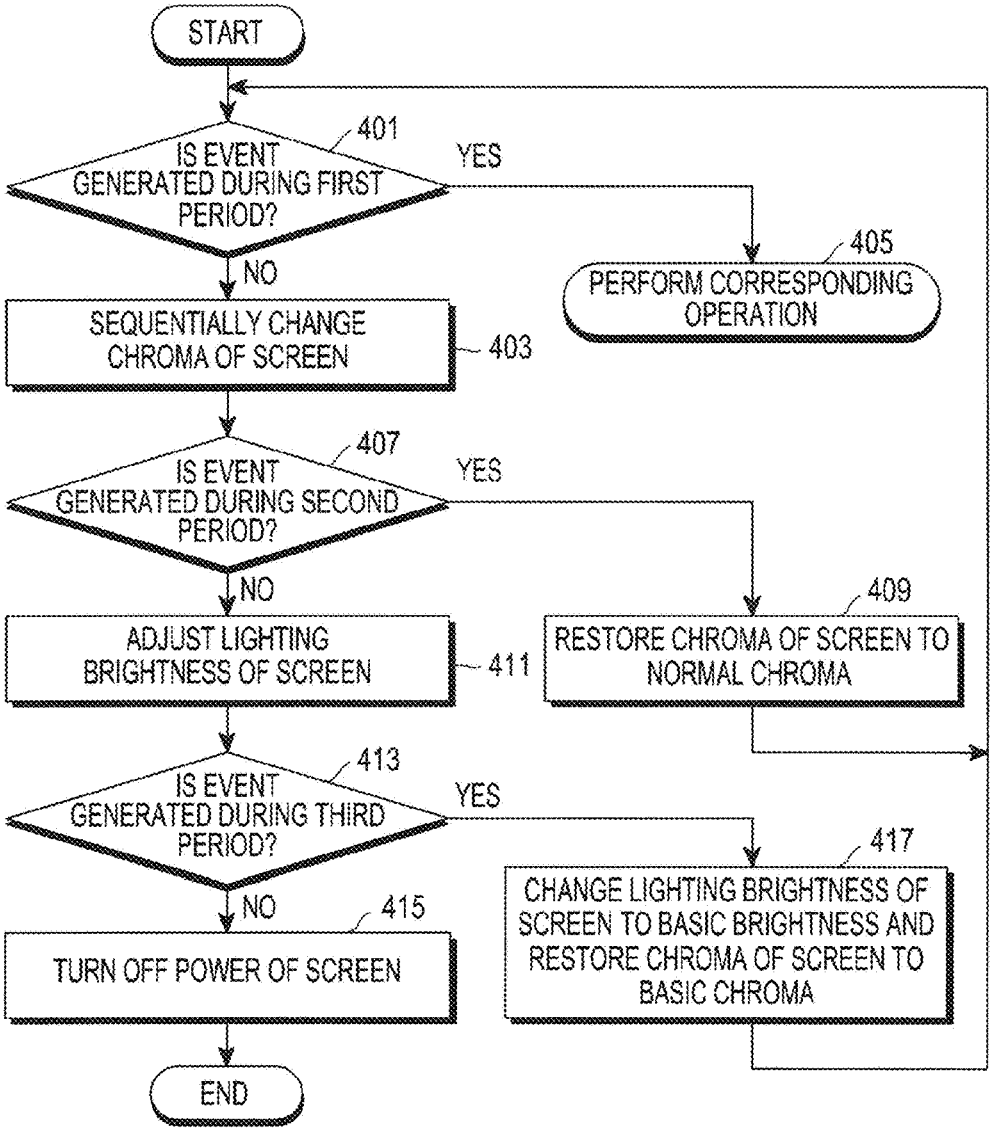
FIGS. 4 and 5 are views illustrating example operation processes of an electronic device according to this disclosure.

FIG. 4 is a view illustrating an example process of controlling a screen according to this disclosure. Referring to FIG. 4, in step 401, when the event is generated in the screen on state, the screen control module 370 checks whether the event is generated during the first period while maintaining the state of the screen as the screen on state.

When the event is generated, in step 405, the screen control module 370 continuously maintains the screen on state of the screen. When the event is not generated during the first period, in step 403, the screen control module 370 changes the state of the screen to the screen protection state by sequentially changing the chroma of the screen. In addition, in step 407, the screen control module 370 checks whether the event is generated during the second period.

When the event is generated during the second period, in step 409, the screen control module 370 restores the screen to the screen on state by restoring the chroma of the screen to the basic chroma. In addition, the screen control module 370 performs step 401. When the event is not generated during the second period, in step 411, the screen control module 370 adjusts the lighting brightness of the screen. For example, the screen control module 370 maintains the screen protection state by darkening the lighting brightness of the screen than before. In step 413, the screen control module 370 checks whether the event is generated during the third period. In step 417, when the event is generated during the third period, the screen control module 370 changes the screen to the screen on state by changing the lighting of the screen to the basic brightness and restoring the chroma of the screen to the basic chroma. In addition, the screen control module 370 performs step 401. When the event is not generated during the third period, in step 415, the screen control module 370 turns off the power of the screen.

Figure 5:
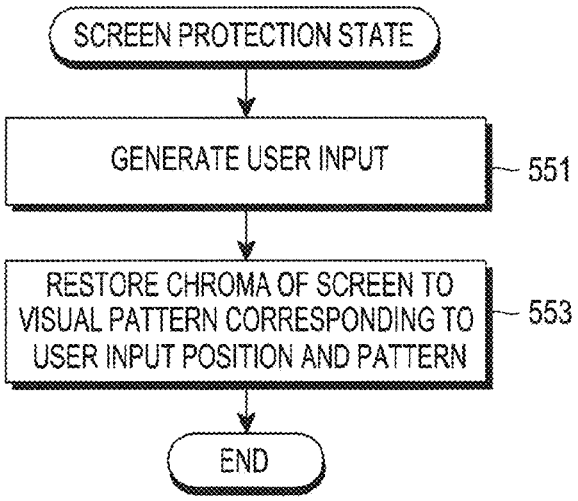

FIG. 5 is a view illustrating an example process of changing the state of the screen from the screen protection state to the screen "on" state according to the user's input according to this disclosure. That is, FIG. 5 illustrates a screen restoration process, when a sensed event is the user's input in a state in which the chroma of the screen is adjusted or the brightness of the screen is darkened. Referring to FIG. 5, in step 551, the screen control module 370 checks whether the user's input is generated while the screen protection state is maintained. Thus, in step 553, the screen control module 370 restores the screen by the visual pattern corresponding to the user input pattern and the position where the user's input is generated. Next, a screen control process is described with reference to FIGS. 6, 7, 8, 9, 10 and 11.

Figure 6:
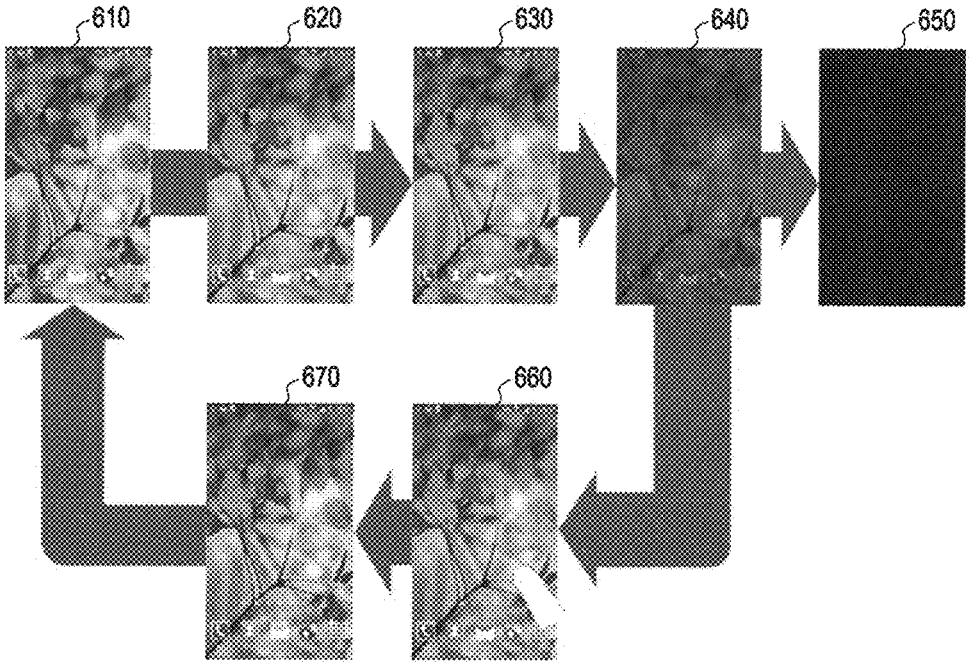
FIG. 6 is a view illustrating an example screen control process according to this disclosure.

FIG. 6 is a view illustrating an example overall processes in which the screen is changed to the screen protection state and then the screen is restored to the screen on state according to this disclosure. Referring to FIG. 6, a screen 610 shows the screen of the screen on state. When the event is generated while the screen "on" state is maintained, the screen is maintained as the screen "on" state. The screen control module 370 monitors whether the event is generated during the first period from the time when the event is generated. When the event is not generated during the first period, the screen control module 370 gradually decreases the chroma of the screen in a sequence of a screen 620 and a screen 630, and thus the screen is changed to the screen protection state. In addition, the elapsed time during the second period from the time when the first period is terminated is checked, and the screen control module 370 monitors whether the event is generated during the second period. When the event is not generated, the screen control module 370 darkens the lighting brightness of the screen as shown in screen 640. In addition, the screen control module 370 checks the elapsed time during the third period and monitor whether the event is generated during the third period. When the event is not generated during the third period, the screen is turned off as shown in screen 650, and thus the screen is changed to the screen "off" state.

However, when the event is generated while in the screen protection state, that is, as shown in screen 620, screen 630, and screen 640, is provided, the screen is changed to the screen "on" state. For example, when the user's input is generated in the screen 640, the lighting brightness of the screen is restored to the basic brightness and the chroma of the screen is also changed to the basic chroma as shown in screen 660 and screen 670. Referring to the screen 660 and the screen 670, the lighting brightness of the screen and the chroma of the screen is changed while the changed area is expanded from a point corresponding to the user's input.

Figure 7:
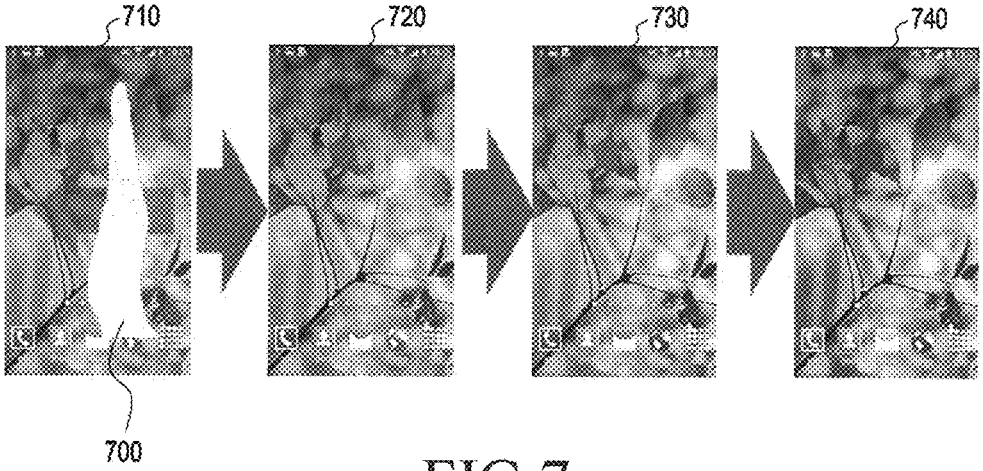
FIGS. 7, 8, 9, 10, and 11 are views illustrating example screen restoration processes according to this disclosure.

FIGS. 7, 8, 9, 10, and 11 illustrate example screen control processes in which a visual pattern corresponding to a user's input is applied when the user's input is generated as the event in the screen protection state according to this disclosure. FIG. 7 illustrates an example screen control process when an air gesture input of a user is generated in the screen protection state according to this disclosure. When the screen control module 370 detects the input of the air gesture of the user in a state in which data or contents are displayed on the screen in a low chroma, the screen control module 370 detects a position where the air gesture is initially started. For example, the air gesture can be an input of a designated gesture through a hand of a user or the like in a non-contact state within a predetermined distance from the screen of the electronic device. In addition, the screen control module 370 detects a pattern of the air gesture, for example, a direction of the air gesture. As shown in screen 710 of FIG. 7, when the screen control module 370 detects a user's input position corresponding to the air gesture 700 and a user's input pattern, that is, a movement from a right side to a left side, the screen control module 370 restores the chroma of the screen to the basic chroma from a right side of the screen and gradually restores the chroma of the screen toward a left direction of the screen as progressively shown in screens 720 and 730. Therefore, a screen in a screen "on" state as shown in screen 740 is provided.

Figure 8:
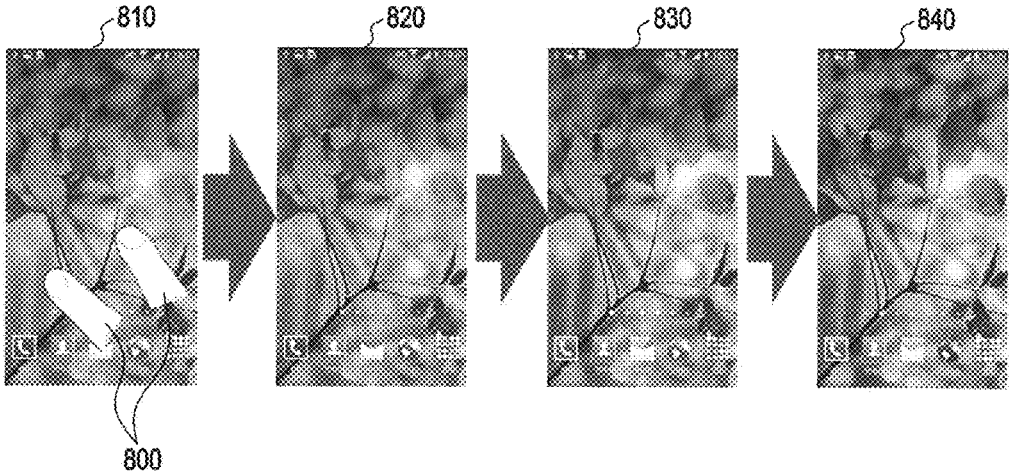

FIG. 8 illustrates an example screen control process when a plurality of touch inputs is generated in the screen protection state according to this disclosure. When the screen control module 370 detects a user's touch input in a state in which data or contents are displayed on the screen in a low chroma, the screen control module 370 detects a point touched by the user. As shown in screen 810 of FIG. 8, multi touch inputs 800 of the user are detected, the screen control module 370 restores the chroma of the screen to the basic chroma from the point touched by the user, and gradually restores the chroma of the screen to the basic chroma from an area around the point touched by the user to remaining areas as progressively shown in screens 820 and 830. Therefore, a screen in a screen "on" state as shown in screen 840 is provided.

Figure 9:
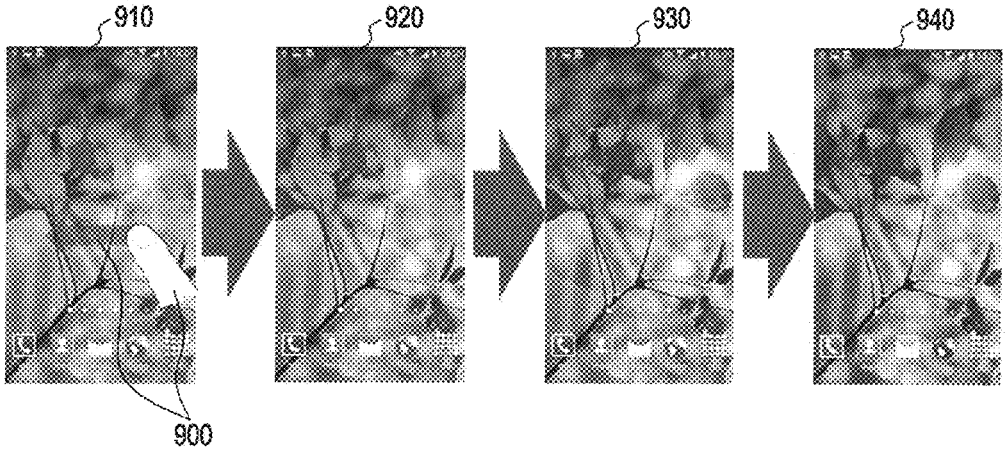

FIG. 9 illustrates an example screen control process when a touch drag input of a user is generated in the screen protection state according to this disclosure. When the screen control module 370 detects an input of a touch drag of the user in a state in which data or contents are displayed on the screen in a low chroma, the screen control module 370 detects a point where a touch is initially started. For example, the touch drag is touching any point of the screen in the electronic device 201 with a finger and taking the finger off from the screen after moving the finger in a predetermined distance in a specific distance in the touched state. In addition, the screen control module 370 detects a touch pattern according to the drag of the user, for example, a touch drag and a touch direction. In a screen 910 of FIG. 9, when a touch input position corresponding to the touch drag 900 and a user's input pattern, that is, the touch drag from a right side to a left side is detected, the screen control module 370 restores the chroma of the screen to the basic chroma from a point of a right side of the screen, where the touch is started, and gradually restores the chroma of the screen to the basic chroma in a left direction as progressively shown in screens 920 and 930. Therefore, a screen in a screen "on" state as shown in screen 940 is provided.

Figure 10:
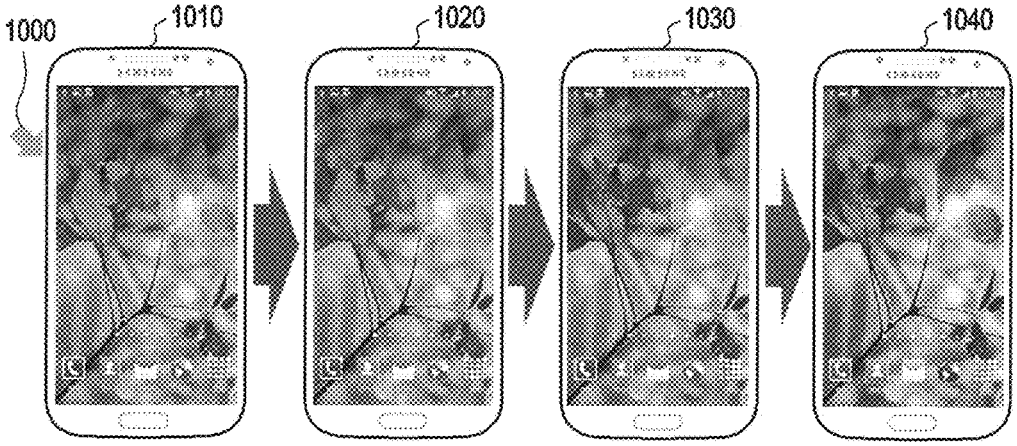

FIG. 10 illustrates an example screen control process when a key input is generated in the screen protection state according to this disclosure. When the screen control module 370 detects an input of a key in a state in which data or contents are displayed on the screen in a low chroma, the screen control module 370 detects a position of the key as a position of a user's input. In a screen 1010 of FIG. 10, the key input 1000 is detected. The screen control module 370 determines the position of the key as the position of the user's input. The screen control module restore the chroma of the screen to the basic chroma from an area adjacent to the position of the key, where an upper left of the screen, and gradually restores the chroma of the screen to the basic chroma from an adjacent to the area restored to the basic chroma to remaining areas as progressively shown in screens 1020 and 1030. Therefore, a screen in a screen "on" as shown in screen 1040 is provided.

Figure 11:
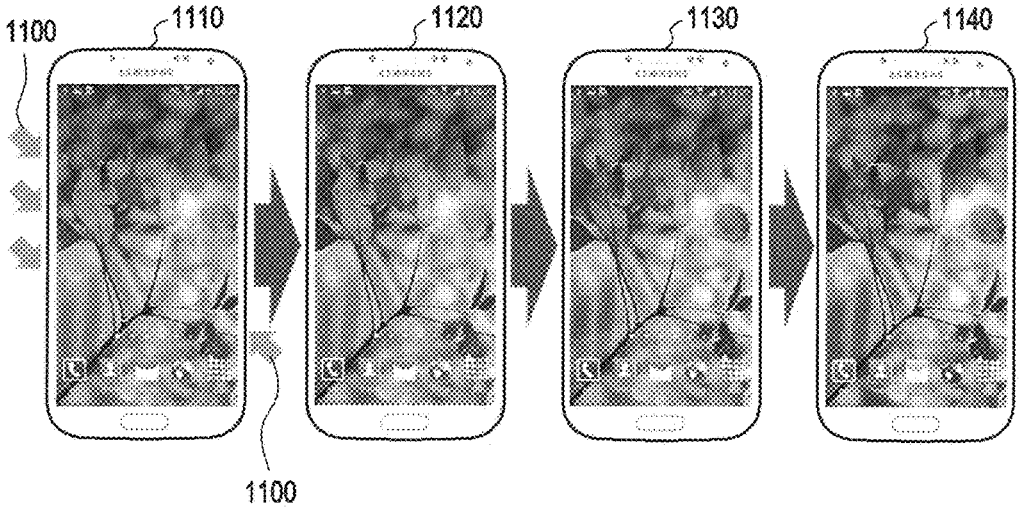

FIG. 11 illustrates an example screen control process when a user grips the electronic device 201 in the screen protection state according to this disclosure. When the electronic device 201 detects a grip of the electronic device 201 by the user through, for example, a grip sensor, in a state in which data or contents are displayed on the screen in a low chroma, the screen control module 370 detects a position where the electronic device 201 is gripped. In a screen 1110 of FIG. 11, when the grip 1100 of the electronic device 201 by the user is detected, the screen control module 370 detects gripped positions. The screen control module 370 restores the chroma of the screen to the basic chroma from a gripped point, and gradually restores the chroma of the screen to the basic chroma remaining areas as progressively shown in screens 1120 and 1130. Therefore, a screen in a screen "on" state as shown in screen 1140 is provided.

Figure 12:
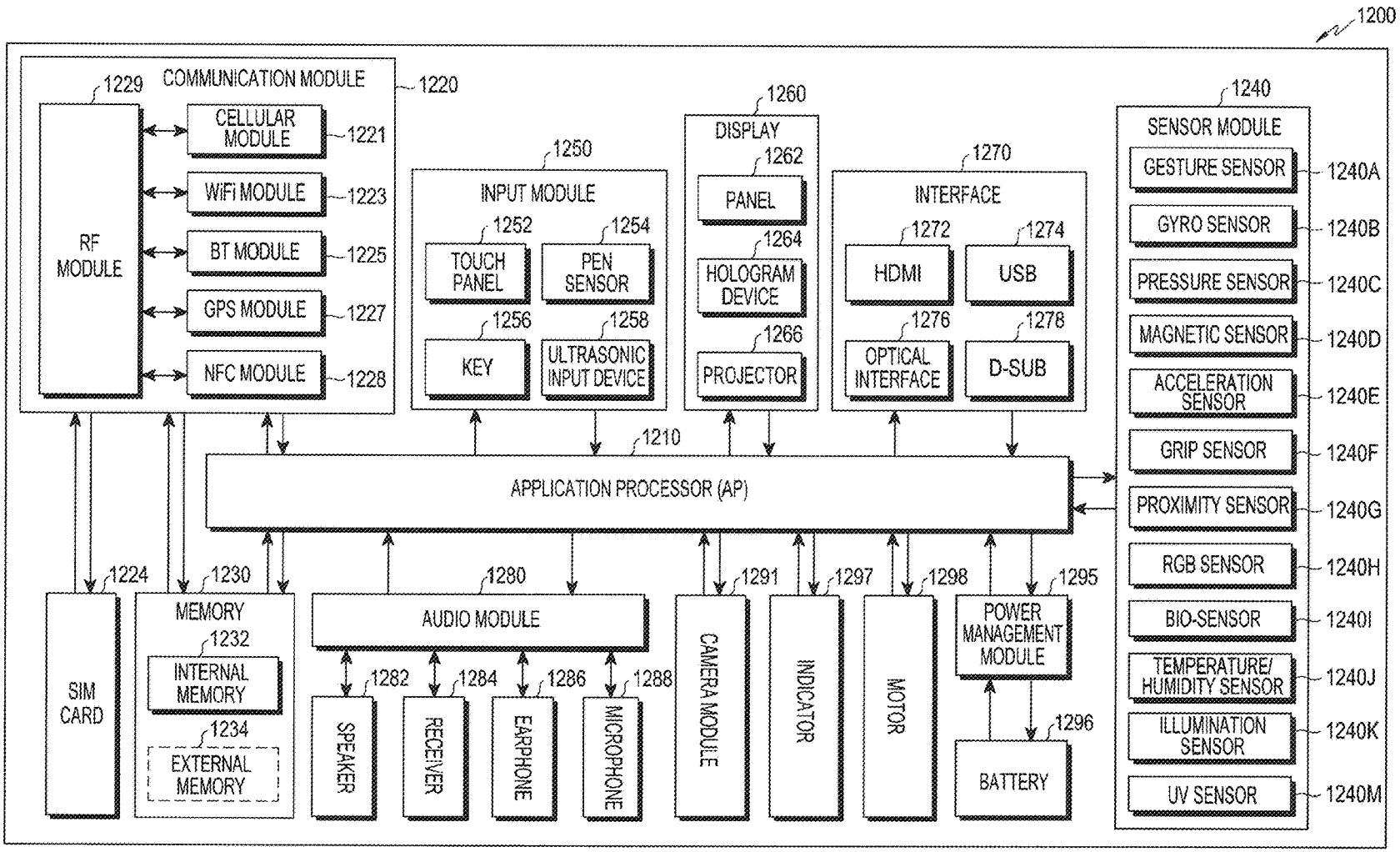
FIG. 12 is a view illustrating a construction of an example electronic device to which a screen control is applied according to this disclosure.

FIG. 12 illustrates a block diagram of an example electronic device 1200 according to this disclosure. The electronic device 1200 constitutes, for example, all or a part of the electronic device 201 shown in FIG. 2. Referring to FIG. 12, the electronic device 1201 includes at least one of an Application Processor (AP) 1210, a communication module 1220, a Subscriber Identifier Module (SIM) card 1224, a memory 1230, a sensor module 1240, an input device 1250, a display 1260, an interface 1270, an audio module 1280, a camera module 1291, a power management module 1295, a battery 1296, an indicator 1297, and a motor 1298.

The AP 1210 controls a plurality of hardware or software components connected to the AP 1210 by driving an operating system or an application program, process various data including multimedia data, and perform calculations. The AP 1210 is embodied as, for example, a System on Chip (SoC). According to an embodiment, the AP 1210 further includes a Graphic Processing Unit (GPU). The communication module 1220 (for example, the communication interface 260) performs data transmission/reception in communication between the electronic device 1201 (for example, the electronic device 201) and other electronic devices (for example, the electronic device 204 and the server 206) connected thereto through a network. According to an embodiment, the communication module 1220 includes a cellular module 1221, a WiFi module 1223, a BlueTooth (BT) module 1225, a Global Positioning System (GPS) module 1227, a Near Field Communication (NFC) module 1228, and a Radio Frequency (RF) module 1229.

The cellular module 1221 provides a voice call, a video call, a Short Message Service (SMS), or an Internet service through a communication network (for example, Long Term Evolution (LTE), LTE-A, Code Division Multiple Access (CDMA), Wideband CDMA (WCDMA), UMTS, WiBro, GSM or the like). Further, the cellular module 1221 distinguishes and authenticates electronic devices within a communication network by using a subscriber identification module (for example, the SIM card 1224). According to an embodiment, the cellular module 1221 performs at least some of the functions that can be provided by the AP 1210. For example, the cellular module 1221 performs at least a part of a multimedia control function.

According to an embodiment, the cellular module 1221 includes a Communication Processor (CP). Further, the cellular module 1221 is implemented by, for example, an SoC. Although the elements such as the cellular module 1221 (such as the communication processor), the memory 1230, and the power management module 1295 are illustrated to be separate from the AP 1210 in FIG. 12, the AP 1210 is implemented to include at least some of the above described elements (such as the cellular module 1221) according to one embodiment.

According to an embodiment, the AP 1210 or the cellular module 1221 (for example, communication processor) loads a command or data received from at least one of a non-volatile memory and other components connected to each of the AP 1210 and the cellular module 1221 to a volatile memory and process the loaded command or data. Further, the AP 1210 or the cellular module 1221 stores data received from or generated by at least one of the other components in a non-volatile memory.

Each of the Wi-Fi module 1223, the BT module 1225, the GPS module 1227, and the NFC module 1228 includes, for example, a processor for processing data transmitted/received through the corresponding module. In FIG. 12, the cellular module 1221, the WiFi module 1223, the BT module 1225, the GPS module 1227, and the NFC module 1228 are illustrated as blocks separated from each other, but at least some (for example, two or more) of the cellular module 1221, the WiFi module 1223, the BT module 1225, the GPS module 1227, and the NFC module 1228 is included in one Integrated Chip (IC) or one IC package. For example, at least some (for example, the CP 1211 corresponding to the cellular module 1221 and a Wi-Fi processor corresponding to the Wi-Fi module 1223) processors corresponding to the cellular module 1221, the Wi-Fi module 1223, the BT module 1225, the GPS module 1227, and the NFC module 1228, respectively, is implemented as one SoC.

The RF module 1229 transmits or receives data, for example, an RF signal. Although not illustrated, the RF module 1229 includes, for example, a transceiver, a Power Amplifier Module (PAM), a frequency filter, a Low Noise Amplifier (LNA), or the like. Further, the RF module 1229 further includes a component for transmitting/receiving electronic waves over a free air space in wireless communication, for example, a conductor, a conducting wire or the like. Although the cellular module 1221, the Wi-Fi module 1223, the BT module 1225, the GPS module 1227, and the NFC module 1228 are illustrated to share one RF module 1229 in FIG. 12, at least one of the cellular module 1221, the Wi-Fi module 1223, the BT module 1225, the GPS module 1227, and the NFC module 1228 transmits or receives the RF signal through a separate RF module.

The SIM card 1224 is a card including a subscriber identification module, and is inserted into a slot formed in a particular portion of the electronic device. The SIM card 1224 includes unique identification information (for example, Integrated Circuit Card IDentifier (ICCID)) or subscriber information (for example, International Mobile Subscriber Identity (IMSI)).

The memory 1230 (for example, memory 230) includes an internal memory 1232 or an external memory 1234. The internal memory 1232 includes at least one of a volatile memory (for example, a Dynamic Random Access Memory (DRAM), a Static RAM (SRAM), a Synchronous Dynamic RAM (SDRAM), and the like) and a non-volatile memory (for example, a One Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a NAND flash memory, a NOR flash memory, and the like).

According to an embodiment of the present disclosure, the internal memory 1232 is a Solid State Drive (SSD). The external memory 1234 further includes a flash drive, for example, a Compact Flash (CF), a Secure Digital (SD), a Micro Secure Digital (Micro-SD), a Mini Secure Digital (Mini-SD), an extreme Digital (xD), a memory stick or the like. The external memory 1234 is functionally connected to the electronic device 1201 through various interfaces. According to an embodiment, the electronic device 1201 further includes a storage device (or storage medium) such as a hard drive.

The sensor module 1240 measures a physical quantity or detects an operation state of the electronic device 1201, and converts the measured or detected information to an electronic signal. The sensor module 1240 includes at least one of, for example, a gesture sensor 1240A, a gyro sensor 1240B, an atmospheric pressure sensor 1240C, a magnetic sensor 1240D, an acceleration sensor 1240E, a grip sensor 1240F, a proximity sensor 1240G, a color sensor 1240H (for example, a Red/Green/Blue (RGB) sensor), a bio-sensor 1240I, a temperature/humidity sensor 1240J, an illumination sensor 1240K, and an Ultra Violet (UV) sensor 1240M. Additionally or alternatively, the sensor module 1240 includes, for example, an E-nose sensor, an ElectroMyoGraphy (EMG) sensor, an ElectroEncephaloGram (EEG) sensor, an ElectroCardioGram (ECG) sensor, an InfraRed (IR) sensor, an iris sensor, a fingerprint sensor or the like. The sensor module 1240 further includes a control circuit for controlling one or more sensors included therein.

The input device 1250 includes a touch panel 1252, a (digital) pen sensor 1254, a key 1256, or an ultrasonic input device 1258. The touch panel 1252 recognizes a touch input through at least one of, for example, a capacitive scheme, a resistive scheme, an infrared scheme, and an ultrasonic scheme. The touch panel 1252 further includes a control circuit. The capacitive scheme touch panel recognizes physical contact or proximity. The touch panel 1252 further includes a tactile layer. In this case, the touch panel 1252 provides a tactile reaction to a user.

The (digital) pen sensor 1254 is embodied, for example, using a method identical or similar to a method of receiving a touch input of a user, or using a separate recognition sheet. The key 1256 includes, for example, a physical button, an optical key or a keypad. The ultrasonic input device 1258 is a device that detects an acoustic wave by a microphone (for example, microphone 1288) of the electronic device 1201 through an input tool generating an ultrasonic signal to identify data and performs wireless recognition. According to an embodiment, the electronic device 1201 receives a user input from an external device (for example, computer or server) connected to the electronic device 1201 by using the communication module 1220.

The display 1260 (for example, the display 250) includes a panel 1262, a hologram device 1264, and a projector 1266. The panel 1262 is, for example, a Liquid Crystal Display (LCD), Active-Matrix Organic Light Emitting Diode (AM-OLED), or the like. The panel 1262 is embodied to be, for example, flexible, transparent, or wearable. The panel 1262 is also configured as one module together with the touch panel 1252. The hologram device 1264 shows a stereoscopic image in the air by using interference of light. The projector 1266 projects light onto a screen to display an image. For example, the screen is located inside or outside the electronic device 1201. According to one embodiment, the display 1260 further includes a control circuit for controlling the panel 1262, the hologram device 1264, or the projector 1266.

The interface 1270 includes, for example, a High-Definition Multimedia Interface (HDMI) 1272, a Universal Serial Bus (USB) 1274, an optical interface 1276, or a D-subminiature (D-sub) 1278. The interface 1270 is included in, for example, the communication interface 260 illustrated in FIG. 2. Additionally or alternatively, the interface 1270 includes, for example, a Mobile High-definition Link (MHL) interface, a Secure Digital (SD) card/Multi-Media Card (MMC) interface, or an Infrared Data Association (IrDA) standard interface. The audio module 1280 bi-directionally converts a sound and an electronic signal. At least some components of the audio module 1280 is included in, for example, the input/output interface 240 illustrated in FIG. 2. The audio module 1280 processes voice information input or output through, for example, a speaker 1282, a receiver 1284, earphones 1286, the microphone 1288 or the like.

The camera module 1291 is a device that photographs an image and a dynamic image. According to an embodiment, the camera module 1291 includes one or more image sensors (for example, a front lens or a back lens), a lens, an Image Signal Processor (ISP), or a flash (for example, LED or xenon lamp).

The power management module 1295 manages power of the electronic device 1201. The power management module 1295 includes, for example, a Power Management Integrated Circuit (PMIC), a charger Integrated Circuit (IC), or a battery or fuel gauge.

The PMIC is mounted to, for example, an integrated circuit or an SoC semiconductor. Charging methods is classified into a wired charging method and a wireless charging method. The charger IC charges a battery and prevents over voltage or over current from a charger. According to an embodiment, the charger IC includes a charger IC for at least one of the wired charging method and the wireless charging method. A magnetic resonance scheme, a magnetic induction scheme, or an electromagnetic scheme is exemplified as the wireless charging method, and an additional circuit for wireless charging, such as a coil loop circuit, a resonance circuit, a rectifier circuit, or the like is added.

The battery gauge measures, for example, a remaining quantity of the battery 1296, or a voltage, a current, or a temperature during the charging. The battery 1296 stores or generates electricity, and supplies power to the electronic device 1201 using the stored or generated electricity. The battery 1296 includes, for example, a rechargeable battery or a solar battery.

The indicator 1297 displays a particular status of the electronic device 1201 or a part thereof (for example, the AP 1210), for example, a booting status, a message status, a charging status, or the like. The motor 1298 converts an electrical signal to a mechanical vibration. The electronic device 1201 includes a processing unit (such as a GPU) for supporting a mobile TV. The processing unit for supporting the mobile TV processes media data according to a standard of Digital Multimedia Broadcasting (DMB), Digital Video Broadcasting (DVB), media flow, or the like.

The above described components of the electronic device according to this disclosure can be formed of one or more components, and a name of a corresponding component element can be changed based on the type of electronic device. The electronic device according to this disclosure includes one or more of the aforementioned components or further includes other additional components, or some of the aforementioned components can be omitted. Further, some of the components of the electronic device according to this disclosure is combined to form a single entity, and thus, equivalently executes functions of the corresponding elements prior to the combination.

The "module" used in various embodiments of the present disclosure may refer to, for example, a "unit" including one of hardware, software, and firmware, or a combination of two or more of the hardware, software, and firmware. The "module" may be interchangeable with a term, such as a unit, logic, a logical block, a component, or a circuit. The "module" may be a minimum unit of an integrated component element or a part thereof. The "module" may be a minimum unit for performing one or more functions or a part thereof. The "module" may be mechanically or electronically implemented. For example, the "module" according to various embodiments of the present disclosure includes at least one of an Application-Specific Integrated Circuit (ASIC) chip, a Field-Programmable Gate Arrays (FPGAs), and a programmable-logic device for performing operations that have been known or are to be developed hereafter.

According to various embodiments, at least part of a device (for example, modules or functions thereof) or a method (for example, operations) according to this disclosure is embodied by, for example, an instruction stored in a computer readable storage medium provided in a form of a programming module. When he command is executed by one or more processors (for example, the processor 120), the one or more processors may execute a function corresponding to the command. The computer-readable storage medium may be, for example, the memory 150. At least a part of the programming module may be implemented (for example, executed) by, for example, the processor 210. At least a part of the programming module may include, for example, a module, a program, a routine, a set of instructions and/or a process for performing one or more functions.

The computer-readable recording medium includes magnetic media such as a hard disk, a floppy disk, and a magnetic tape, optical media such as a Compact Disc Read Only Memory (CD-ROM) and a Digital Versatile Disc (DVD), magneto-optical media such as a floptical disk, and hardware devices specially configured to store and perform a program instruction (for example, programming module), such as a Read Only Memory (ROM), a Random Access Memory (RAM), a flash memory and the like. In addition, the program instructions include high class language codes, which can be executed in a computer by using an interpreter, as well as machine codes made by a compiler. The aforementioned hardware device is configured to operate as one or more software modules in order to perform the operation of various embodiments of the present disclosure, and vice versa.

A module or a programming module according to the present disclosure includes at least one of the described component elements, a few of the component elements is omitted, or additional component elements is included. Operations executed by a module, a programming module, or other component elements according to various embodiments of the present disclosure are executed sequentially, in parallel, repeatedly, or in a heuristic manner. Further, some operations are executed according to another order or can be omitted, or other operations can be added.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method to control a screen of an electronic device, the method comprising:

checking whether an event is generated during a first period in a state in which a screen is displayed;

changing a chroma of the screen when the event is not generated during the first period;

checking whether the event is generated during a second period;

adjusting a lighting brightness of the screen when the event is not generated during the second period;

checking whether the event is generated during a third period; and restoring the lighting brightness of the screen to a lighting brightness that is not changed and restoring the chroma of the screen to a chroma that is not changed, when the event is generated during the third period, wherein, when the event is a key input, the chroma of the screen is restored to the chroma that is not changed from an area adjacent to a position where a key is installed to a remaining area except for the area adjacent to the position.

2. The method of claim 1, wherein the second period is a predetermined period from a time when the first period is terminated, and wherein the method further comprises restoring the chroma of the screen to the chroma that is not changed when the event is generated during the second period.

3. The method of claim 2, further comprising:

turning off power to the screen when the event is not generated during the third period.

4. The method of claim 3, wherein the third period is a predetermined period from a time when the second period is terminated.

5. The method of claim 1, wherein the chroma of the screen is gradually changed.

6. A method to control a screen of an electronic device, the method comprising:

checking whether an event is generated during a first period in a state in which a screen is displayed;

changing a chroma of the screen when the event is not generated during the first period;

checking whether the event is generated during a second period;

adjusting a lighting brightness of the screen when the event is not generated during the second period;

checking whether the event is generated during a third period; and restoring the lighting brightness of the screen to a lighting brightness that is not changed and restoring the chroma of the screen to a chroma that is not changed, when the event is generated during the third period, wherein, when the event is a grip for the electronic device, the chroma of the screen is restored to the chroma that is not changed from an area corresponding to a point where the grip is generated to a remaining area except for the area corresponding to the point.

7. An electronic device comprising:

a display; and a screen control module configured to:

check whether an event is generated during a first period in a state in which a screen is displayed on the display, change a chroma of the screen when the event is not generated during the first period, check whether the event is generated during a second period, adjust a lighting brightness of the screen when the event is not generated during the second period, check whether the event is generated during a third period, and restore the lighting brightness of the screen to a lighting brightness that is not changed and restoring the chroma of the screen to a chroma that is not changed when the event is generated during the third period, wherein, when the event is a key input, the screen control module is configured to restore the chroma of the screen to the chroma that is not changed from an area adjacent to a position where a key is installed in the electronic device to a remaining area except for the area adjacent to the position.

8. The electronic device of claim 7, wherein the second period is a predetermined period from a time when the first period is terminated, and wherein the screen control module is configured to restore the chroma of the screen to the chroma that is not changed when the event is generated during the second period.

9. The electronic device of claim 7, wherein the screen control module is configured to:

turn off power to the screen when the event is not generated during the third period.

10. The electronic device of claim 9, wherein the third period is a predetermined period from a time when the second period is terminated.

11. The electronic device of claim 7, wherein the screen control module is configured to gradually change the chroma of the screen.

12. An electronic device comprising:

a display; and a screen control module configured to:

check whether an event is generated during a first period in a state in which a screen is displayed on the display, change a chroma of the screen when the event is not generated during the first period, check whether the event is generated during a second period, adjust a lighting brightness of the screen when the event is not generated during the second period, check whether the event is generated during a third period, and restore the lighting brightness of the screen to a lighting brightness that is not changed and restoring the chroma of the screen to a chroma that is not changed when the event is generated during the third period, wherein, when the event is a grip for the electronic device, the screen control module is configured to restore the chroma of the screen to the chroma that is not changed from an area corresponding to a point where the grip is generated to a remaining area except for the area corresponding to the point.

* * * * *